United States Patent [19]

Heim

[11] 4,100,926

[45] Jul. 18, 1978

[54] APPARATUS FOR ULTRASONIC CLEANING WITH LIQUID SOLVENT IN A BLANKET OF VAPOR

[75] Inventor: Richard C. Heim, Ellicott City, Md.

[73] Assignee: Westinghouse Electric Corp., Pittsburgh, Pa.

[21] Appl. No.: 725,214

[22] Filed: Sep. 22, 1976

[51] Int. Cl.[2] ..... B08B 3/12

[52] U.S. Cl. ..... 134/64 R; 134/184

[58] Field of Search ..... 134/1, 64 R, 122 R, 134/184, 15

[56] References Cited

U.S. PATENT DOCUMENTS

| | | | |
|---|---|---|---|
| 3,175,567 | 3/1965 | Crawford | 134/1 X |
| 3,525,243 | 8/1970 | Chrablow | 134/1 X |
| 3,871,982 | 3/1975 | Idstein | 134/64 R X |

FOREIGN PATENT DOCUMENTS

| | | | |
|---|---|---|---|
| 9,724 | 12/1963 | Japan | 134/64 R |
| 13,726 | 1/1966 | Japan | 134/64 R |
| 204,549 | 1/1968 | U.S.S.R. | 134/1 |

*Primary Examiner*—Robert L. Bleutge
*Attorney, Agent, or Firm*—C. M. Lorin

[57] ABSTRACT

An elongated workpiece is passed through the axis of a cylindrical ultrasonic transducer in a conduit containing solvent agent for ultrasonic cleaning. The cleaning action is performed with liquid solvent in a blanket of saturated vapor maintained by a solvent boiling sump, while the transducer is kept isolated from the vapor by a special compartment communicating only with the atmosphere for air cooling. Vestibules allow an overflow of solvent from the conduit in entry and exit chambers traversed by the workpiece and circulation of condensate is maintained to and from a storage sump of liquid solvent.

3 Claims, 3 Drawing Figures

APPARATUS FOR ULTRASONIC CLEANING WITH LIQUID SOLVENT IN A BLANKET OF VAPOR

BACKGROUND OF THE INVENTION

It is generally known, for instance from U.S. Pat. No. 3,350,734 dated Nov. 7, 1967 of Holm, to have a liquid solvent, such as trichloroethylene and tetrachloroethylene, kept at boiling temperature while maintaining a layer of vapor above the liquid phase by condensation of the vapor with cooling coils establishing a constant boundary layer between air and vapor, and it is also generally known to pass a strip of material into such liquid solvent, and/or into the vapor thereof, in order to dissolve grease present on the strip.

It is known to produce high energy ultrasonic agitation for precision cleaning of an intricate workpiece. The workpiece is immersed in a bath containing solvent through which ultrasonic energy is applied from a transducer mounted against the external wall of the bath. Intense and thorough cleaning of the most intricate surfaces of the workpiece is made possible by cavitation due to the formation, under energy at ultrasonic frequency, of gaseous bubbles within the liquid solvent which burst against the contaminated surface (see for instance U.S Pat. No. 3,066,688 of O'Neill dated Dec. 4, 1962.) It has been found that the alternate formation and collapse of bubbles in the solvent near the surface of the workpiece actually disintegrates particles of foreign matter thereon and result in an ultrasonic cleaning far more effective than any mechanical or chemical agent and without deterioration of the workpiece.

It is further known that a blanket of vapor above the surface of the solvent is necessary in order to prevent contamination of the solvent by infiltration of air, since the intensity of cavitation is reduced once air has been dissolved into the solvent. To this effect, an ultrasonic degreaser has been designed in which two solvent sumps are combined. One sump is at boiling temperature for generating vapor. A second sump is juxtaposed serving as a storage sump of distilled solvent. A common blanket of vapor is maintained above the surfaces of the two sumps by a condensating coil establishing a boundary with the open air at the top. The condensate from the second or storage sump overflows into the boiling sump. The workpiece is treated in the storage sump, with the transducer preferably mounted right under the tank.

Another difficulty exists with degreasers when the workpiece is a strip, or wire, instead of a single part. Then, continuous cleaning through the bath of solvent must be provided. It is known from U.S. Pat. No. 3,525,243 dated Aug. 25, 1970 to pass a wire through a bath of freon with transducers in the bath imparting longitudinal vibrations to the wire between two points thereof. It is also known from U.S. Pat. No. 3,582,400 dated June 1, 1971 to immerse cylindrical ultrasonic transducers in a bath of solvent and to unroll a wire through an axial opening of the transducer where it is exposed to cavitation agitation for cleaning purpose.

It is not desirable to immerse an ultrasonic transducer in a bath of solvent. First there is a risk of corrosion. Secondly, maintenance and replacement of the transducers are not facilitated by the environment of the fluid. Thirdly, as shown in the prior art, the choice of a transducer becomes more limited as a result of the requirement that it be placed into the bath. Finally, coupling of the continuous strip, or wire, in the bath with the transducer therein requires some special design to accommodate one with the other.

A preferred solution for effective cleaning of an elongated workpiece continuously supplied through a path of cavitation agitated fluid under ultrasonic energy is to pass the workpiece one way through the axis of a cylindrical transducer within a conduit mounted thereacross and to circulate fluid through this conduit continuously to and from two tanks separated by a cleaning stage so that clean fluid be continuously replenished at the interface between transducer and workpiece in the zone of cavitation. The constant supply of fresh solvent in the conduit along the axis of the cylindrical transducer insures a most effective cleaning action. However, maximum cleaning also requires total protection from the atmosphere.

The main object of the present invention is to provide ultrasonic cleaning apparatus for in line cleaning of continuous wire or strip in which the transducer is coupled to a cleaning solvent in liquid state without being itself in contact with the liquid solvent, and in which any interface of the solvent with air is prevented by a blanket of solvent vapor, but without exposing the transducer to vapor solvent.

SUMMARY OF THE INVENTION

A cylindrical transducer is mounted around a sealed axial conduit containing solvent in liquid state and an elongated workpiece is continuously being passed through the transducer within said conduit. An entrance and an exit vestibule provide respective return paths for the liquid and allow passage of the workpiece at the input and output sides of the apparatus, respectively. The cylindrical transducer is insulated from the solvent in either form by a sealed compartment. A boiling sump and a juxtaposed storage pump are provided above which the transducer compartment with an axial conduit therethrough and two adjoining vestibules are mounted. A blanket of vapor formed by the boiling sump is maintained above the two sumps so as to totally surround the degreasing section between an entry port of the workpiece and an exit port of the workpiece. Solvent from the storage sump is pumped into the conduit in order to maintain solvent circulation. Solvent from the two vestibules is collected to be returned to the boiling sump. Each vestibule provides an interface between the liquid solvent from the conduit and the vapor region and is traversed by the entering, or exiting, workpiece. Condensation coils establish a fixed boundary between the vapor and the air at the top of the apparatus, well above the degreasing section, but under the top of the transducer compartment.

DESCRIPTION OF THE PREFERRED EMBODIMENT OF THE INVENTION

Figure 1:
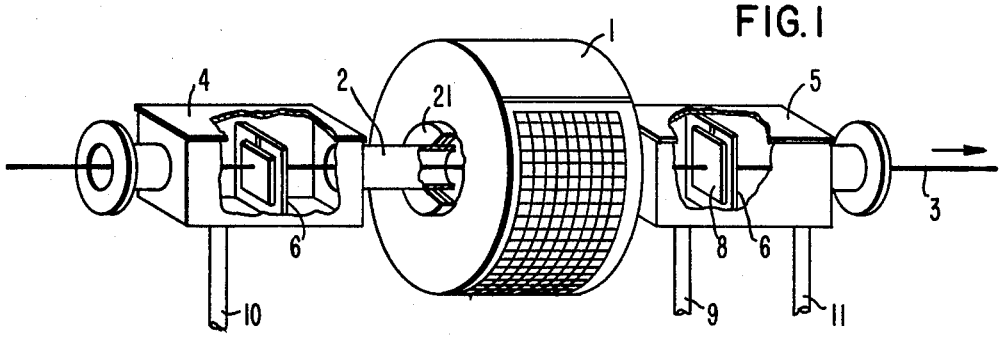
FIG. 1 shows an apparatus of the prior art comprising a cylindrical transducer coupled to a conduit in which flows the cleaning solvent with two vestibules at each end through which the workpiece to be cleaned is being passed continuously along the axis of the transducer.

Referring to FIG. 1, a cylindrical transducer 1 is shown acoustically coupled with liquid solvent contained in an axial conduit 2 through which a workpiece 3 is passed and exposed, in the central region of the transducer, to cleaning action by cavitation effect due to ultrasonic waves converging under electromagnetic excitation of the transducer. Conduit 2 is connected at each end by a gasket to chambers 4 (at the entry) and 5 (at the exit).In each chamber the elongated workpiece, for instance a wire, is passed through a baffle 6 provided with a slot 7, and through a plate 8 having a central orifice. The baffle and plate form a partition within the chamber defining a vestibule in which the fluid in the conduit 2 accumulates. The fluid is allowed to overflow from each vestibule above the baffle into the second compartment of the chamber. A pump system (not shown) circulates the liquid solvent into the exit vestibule with a pipe 9. The overflow from each vestibule is returned by pipes 10 and 11 from the entry and exit chamber (4 and 5) respectively.

Figure 2:
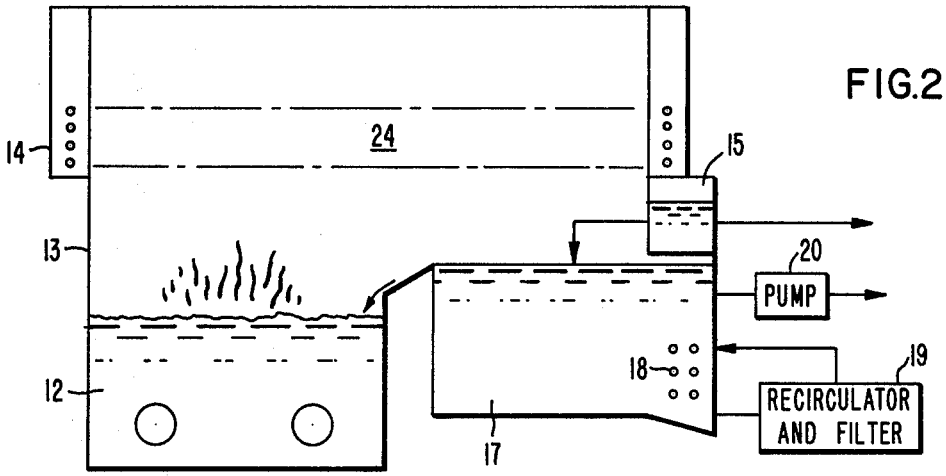
FIG. 2 shows an apparatus of the prior art comprising the circulation cycle of solvent in a vapor degreaser from the boiling liquid state to vapor in one sump; to the liquid state on the condensing coils, through a water separator and into a second sump which overflows into the first sump. The blanket of vapor is maintained above the two sumps.

Referring to FIG. 2, the circulation of fluid between liquid and vapor states as well as between clean and contaminated solvent is shown schematically. Solvent is brought to the boiling point in a boiling sump 12. Vapor from the boiling sump is prevented at the top from escaping the overall tank 13 by condensing coils 14 establishing with the condensate a boundary between vapor and air in the region 24. Water from condensation at the interface with the atmosphere is evacuated through a water separator and drained as shown at 15. The distilled solvent flows into the storage sump 17, which overflows into the boiling sump 12.

The storage sump 17 which is kept at lower temperature by cooling coil 18 which removes heat added by the ultrasonic transducer and the vapor blanket. During the degreasing operation in a vapor degreaser the solvent becomes contaminated with soluble and/or insoluble soil. The soluble and insoluble contaminates accumulate into the boiling sump. In order to remove insolubles from the storage sump, special filtering is provided. Filtering is schematized by a recirculator 19 shown coupled to the storage pump for the sake of clarity. A pump 20 provides a general circulation of the liquid solvent to be used, for instance, for spray washing of the workpiece, if required.

Figure 3:
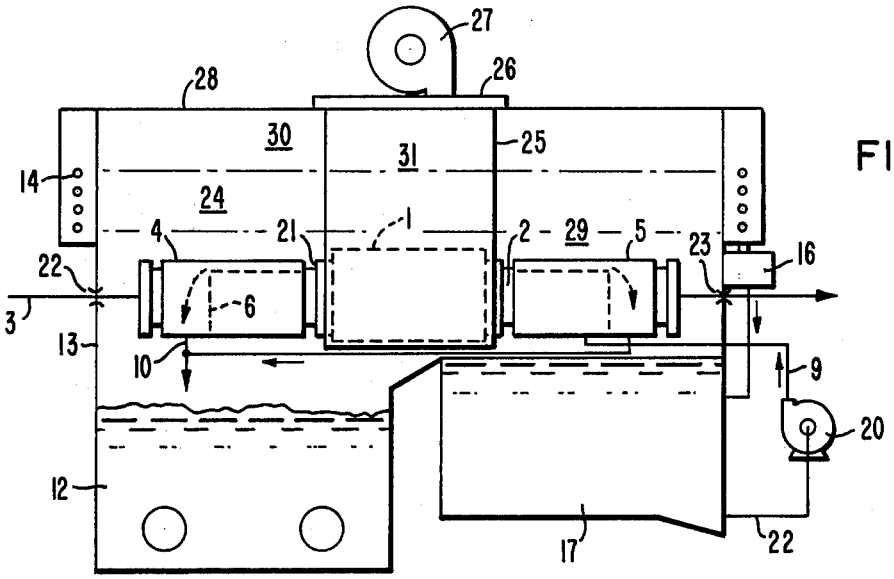
FIG. 3 shows the apparatus according to the invention combining the units of FIGS. 1 and 2.

Referring to FIG. 3, the apparatus according to the invention is shown schematically using the same reference numerals to indicate like parts which are already shown in FIG. 1, or FIG. 2. Solvent in the vapor state extends within a region 29. Air above the blanket of vapor occupies region 30 at the top of tank 13. The transducer 1 is placed together with the central conduit 2 and the two chambers 4, 5 within region 29, so that the saturated vapor completely insulates the liquid solvent flowing in the vestibules from any contamination by air. However, the transducer itself is completely protected from exposure to the vapor by a sealed baffle 25 extending around conduit 2 up to the air region 30 and the lid of the tank 28. A fan 27 at the top provides air cooling for the transducer. In this manner a separate compartment 31 is provided for the cylindrical transducer, totally isolated from the solvent in the vapor or in the liquid state. However, free access to the transducer is available while insuring the necessary cooling. Circulation of fluid is provided by pump 20 from the storage sump 17 into conduit 2 via pipe 9.

Indeed, tight mechanical connections are provided around conduit 2 by gaskets 21 mounted between each of the chambers 4 and 5 and baffle 25 of compartment 31.

While a higher level of cavitation can be achieved by ultrasonic cleaning in solvent when the solvent is free from dissolved air, it appears that the apparatus just described very effectively maintains air-free solvent by maintaining a blanket of saturated vapor over the liquid solvent and around the vestibules of the chambers 4, 5. While so doing, the transducer itself is isolated from the vapor and can easily be air cooled. The degreaser boiling sump not only serves to maintain the saturated vapor blanket, it also boils the solvent for distillation at a rate sufficient, when condensed on the condensing coils, to provide clean distilled solvent for the cleaning process. The distilled solvent flows back to the storage sump from which the liquid solvent is pumped into the exit vestibule. All solvent from the cleaning conduit 2 is returned to the boiling sump.

I claim:

1. Apparatus for ultrasonic cleaning with liquid solvent comprising:
   - an enclosure;
   - means in a first region of said enclosure containing liquid solvent for generating vapor from said liquid solvent;
   - means in a second region of said enclosure for condensing said vapor, said second region means being spaced from said first region means and said first and second region means defining therebetween a third region of said enclosure occupied by saturated vapor;
   - means in said third region containing liquid solvent;
   - transducer means mounted in said third region for applying ultrasonic energy to said third region liquid solvent;
   - an elongated workpiece passed through said enclosure in said third region thereof, and passed through said third region liquid solvent for conducting ultrasonic cleaning of said workpiece by said transducer means; and
   - means provided in said third region for insulating said transducer means from said vapor and said liquid solvent.

2. Apparatus for ultrasonic cleaning with liquid solvent comprising:
   - an enclosure;
   - means in a first region of said enclosure containing liquid solvent for generating vapor from said liquid solvent;
   - means in a second region of said enclosure for condensing said vapor, said second region means being spaced from said first region means and said first and second region means defining therebetween a third region of said enclosure occupied by saturated vapor;
   - means in said third region containing liquid solvent;
   - transducer means mounted in said third region for applying ultrasonic energy to said third region liquid solvent;
   - an elongated workpiece passed through said enclosure in said third region thereof, and passed through said third region liquid solvent for conducting ultrasonic cleaning of said workpiece by said transducer means; and means in said third region for insulating said transducer means from said vapor and said liquid solvent;

with said enclosure further including a fourth region containing air, said second region means establishing a boundary between vapor in said second region and air in said fourth region, said insulating means extending through said second region into said fourth region.

3. The apparatus of claim 2 with ventilating means mounted on said enclosure for air cooling of said transducer through said insulating means and from said fourth region.

* * * * *